US010138607B2

(12) United States Patent
Aquino

(10) Patent No.: US 10,138,607 B2
(45) Date of Patent: Nov. 27, 2018

(54) SNOW-PLOW BLADE AND COVER-PLATE

(71) Applicant: Matthew J Aquino, Fairport, NY (US)

(72) Inventor: Matthew J Aquino, Fairport, NY (US)

( * ) Notice: Subject to any disclaimer, the term of this patent is extended or adjusted under 35 U.S.C. 154(b) by 0 days.

(21) Appl. No.: 15/700,146

(22) Filed: Sep. 10, 2017

(65) Prior Publication Data

US 2018/0100279 A1 Apr. 12, 2018

Related U.S. Application Data

(60) Provisional application No. 62/406,813, filed on Oct. 11, 2016.

(51) Int. Cl.
*E01H 5/06* (2006.01)

(52) U.S. Cl.
CPC ..... *E01H 5/065* (2013.01); *E01H 5/061* (2013.01)

(58) Field of Classification Search
CPC ..... E01H 5/061; E01H 5/065
See application file for complete search history.

(56) References Cited

U.S. PATENT DOCUMENTS 574,567 A * 1/1897 Pepin ..... E01H 5/065 37/269
1,871,565 A * 8/1932 Soule ..... E01H 5/061 37/272
3,028,692 A * 4/1962 Brock ..... E01H 5/065 15/245
3,465,456 A * 9/1969 Meyer ..... E01H 1/105 15/245
5,638,617 A * 6/1997 Belanger ..... E01H 5/06 37/232
7,159,344 B2 * 1/2007 Karhi ..... A61B 5/01 172/811
7,874,085 B1 * 1/2011 Winter ..... E01H 5/061 172/701.3
8,443,911 B2 * 5/2013 Tutschek ..... A01B 31/00 172/701.3
8,763,281 B2 * 7/2014 Coulombe ..... E01H 5/066 37/266
8,984,778 B2 * 3/2015 Fox ..... E01H 5/062 37/266
9,163,379 B2 * 10/2015 Winter ..... E01H 5/061
9,428,874 B2 * 8/2016 Winter ..... E01H 5/061
9,562,342 B2 * 2/2017 Winter ..... E02F 3/8157
2009/0223090 A1 * 9/2009 Hunt ..... E01H 5/061 37/266
2014/0373398 A1 * 12/2014 Winter ..... E01H 5/061 37/266
2017/0191236 A1 * 7/2017 Winter ..... E01H 5/061

* cited by examiner

*Primary Examiner* — Jamie L McGowan
(74) *Attorney, Agent, or Firm* — Aleksandar Nikolic

(57) ABSTRACT

A snow-plow blade having a blade, an insert, and a cover-plate, with the cover-plate having a crenellated structure and abrasion resistant steel, the structure extending the service life of the snow-plow blade and improving snow-plow blade maintenance servicing.

19 Claims, 4 Drawing Sheets

SNOW-PLOW BLADE AND COVER-PLATE

CROSS-REFERENCE TO RELATED APPLICATIONS

This Application claims priority to U.S. Provisional Patent Application Ser. No. 62/406,813 filed Oct. 11, 2016, the contents of which are incorporated by reference herein as if set forth in their entirety for all purposes as if put forth in full below.

STATEMENT REGARDING FEDERALLY SPONSORED RESEARCH OR DEVELOPMENT

None

THE NAMES OF THE PARTIES TO A JOINT RESEARCH AGREEMENT

None

BACKGROUND OF THE INVENTION

There are a variety of snow-plow blades configurations, however a commonly used configuration includes a blade, a cover-plate, and an insert. The insert is the portion of the blade that provides the most contact with ground being plowed. In addition, the blade may make contact with the snow, sleet, slush, and other deposits on the ground. The insert is constructed of a very hard material, usually carbide. Carbide is very hard but also very brittle. These properties give the insert a long wear life but make it susceptible to fractures. The blade is usually constructed from steel, providing some protection for the insert, but not the portion that is outside the blade. In order to provide additional protection for the insert portion of the blade, a cover-plate is usually affixed to the blade. The cover-plate often comes in contact with the ground and road obstacles, including but not limited to bridge joints, manholes, catch basins, and rocks.

A standard municipal snow-plow mold board can accommodate a 132 inch (3.35 m) snow-plow blade but it is common that the snow-plow blades are attached in segments. The blades usually come in widths of 36 inch (0.91 m), 48 inch (1.22 m), and inch (3.35 m) segments. It is common to use three blades for easier connection to the mold board. However, it is also common for the cover-plate to be 132 inches (3.35 m), in order to cover the entire blade width. This configuration includes most municipal plow types and applications, including: front plows, reversible plows, and wing plows or side plows.

The standard V-Blade plows generally come in two sizes, 102 inches (2.59 m) or inches (2.9 m). It is also common that snow-plow blades for the V-Blade are attached in segments, with segments commonly being 40⅞ inches (1.04 m) or 46⅞ inches (1.19 m). Cover-plates are generally sized to the blade or segment.

The weight of the blades, inserts and cover-plate can be several hundred pounds, since cover plates may be affixed to multiple blades prior to attachment to a mold board. Currently, snow-plow blades are manually attached to the mold board and require multiple people to attach it. This poses a safety concern due to the weight and size of the cover-plate in a heavy equipment and extreme weather environment.

Cover-plates also tend to be a lot higher than necessary, often covering most of the blade. Blades are relatively sturdy and generally require the cover only to protect the portion of the blade that contains the insert. Thus a lot of material is wasted when the blades and cover-plate are discarded. Because of the harsh environment in which plows operate, insert and blade wear are often difficult to detect in this configuration. This leads to too frequent blade and insert changes or blades and inserts that are used beyond their useful service life, leading to material waste or plow damage or poor snow removal.

Snow plows blades also need to be configured for the appropriate plow attack angle. In a snow storm, this can lead to delays in plowing service as multiple blade parts may need to be attached to a mold board and configured during blade changes to accommodate different attack angles for different plowing configurations.

The current invention provides a lighter snow-plow blade construction that provides longer blade and insert life but is light enough for a single person to replace. It further provides easily visible blade wear indication and streamlined attack angle configuration. The current invention also provides a snow-plow blade design that uses less cover-plate material, creating less waste material in both the construction and disposal of snow-plow blades.

Disclosed herein in certain preferred embodiments is snow-plow blade and cover-plate: comprising a blade, an insert, and a crenellated cover-plate.

DETAILED DESCRIPTION

Figure 1:
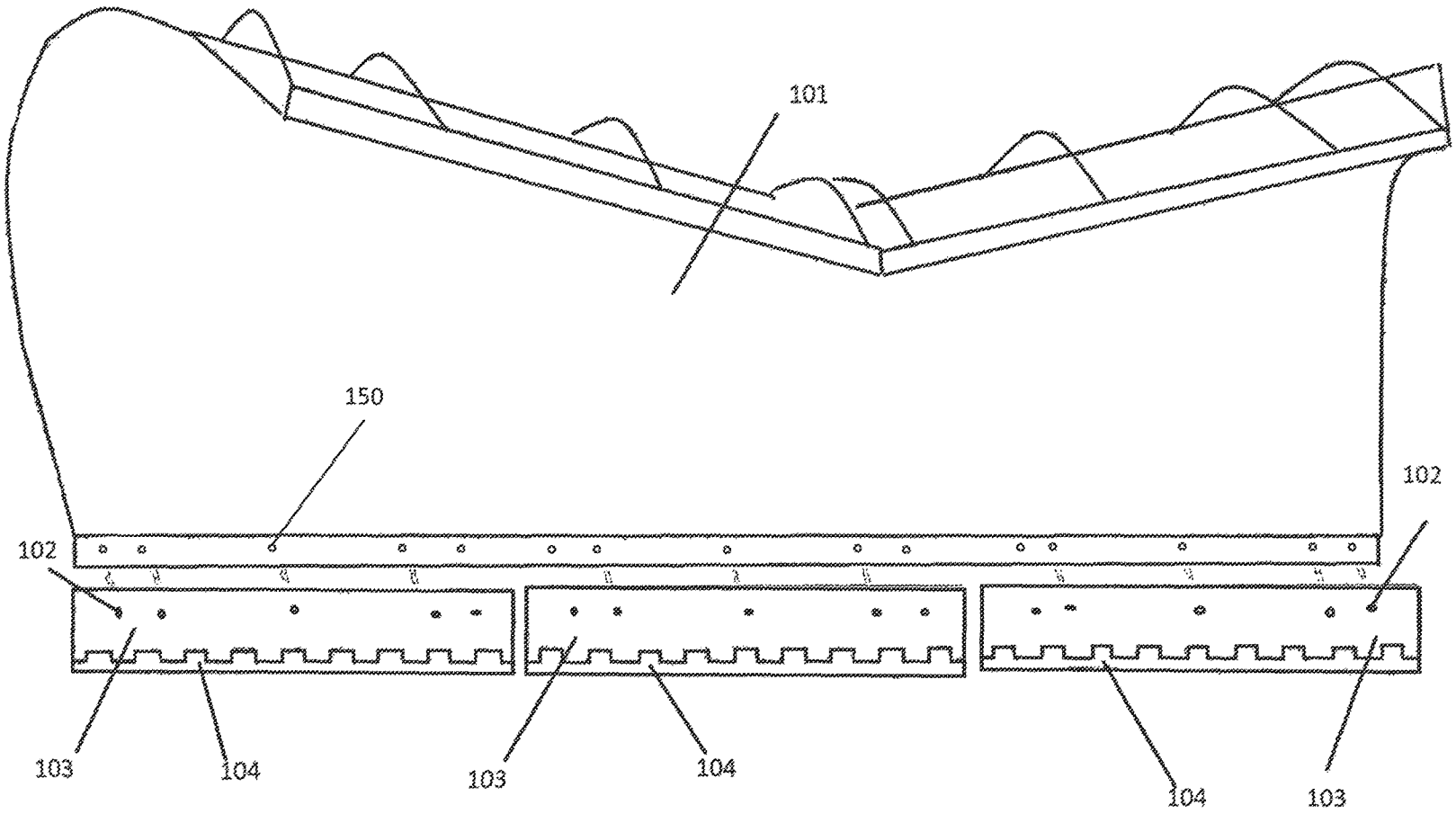
FIG. 1 depicts the snow-plow blades of the current invention as integrated structures in relation to a mold board.

Before explaining some embodiments of the present invention in detail, it is to be understood that the invention is not limited in its application to the details of any particular embodiment shown or discussed herein since the invention comprises still further embodiments, as described by the granted claims.

Unless otherwise clearly specified the terminology used herein is for the purpose of description and not of limitation. Further, although certain structures, functions, and/or methods are described with reference to certain steps that are presented herein in a certain order, in many instances, these steps may be performed in any order as may be appreciated by one skilled in the art, and the structures, functions, and/or methods are not limited to the particular arrangement of steps disclosed herein.

As utilized herein, the following terms and expressions will be understood as follows:

The term "about" as utilized herein refers to the statistically average variability as is typically found in the art of the invention herein.

The term "blade" refers to a cutting implement.

The expression "functional contact" refers to the contact between an object and a plane but for unexpected wear, and variances or other irregularities due to machining or tool tolerance limits in the invention manufacturing process.

The expression "integrated structure" refers to multiple components affixed so that the multiple components substantially comprise a single structure and the components are not easily removable into individual constituent components.

The expression "snow-plow blade" refers to a structure having a blade, an insert, and a cover-plate.

The present invention is a snow-plow blade comprising a blade, an insert, and a cover-plate. The blade comprises a blade front face and a blade bottom edge. The insert is affixed to the blade such that a portion of the insert extends below the blade bottom edge. The cover-plate comprises abrasion resistant steel and a crenellated structure, wherein the crenelated structure comprises a solid region, more than one raised region, and more than one trough region. The cover-plate is affixed to the front of the blade, said cover-plate substantially spanning the width of the blade, and with a portion of the cover-plate solid region extending below the blade bottom edge.

A further embodiment of the invention is a cover-plate for a snow-plow blade comprising a crenellated structure and abrasion resistant steel. The crenelated structure comprises a solid region, more than one raised region, and more than one trough region. The cover-plate is affixed to the front of a blade, with said cover-plate substantially spanning the width of the blade, and with a portion of the cover-plate solid region extending below the blade bottom edge.

A further embodiment of the invention is in a snow-plow blade the improvement for extending the service life and maintenance servicing of the snow-plow blade which comprises a cover-plate affixed to the front of a blade, the cover-plate extending below the blade bottom edge, and said cover-plate spanning the width of the blade, with each cover-plate comprising a crenellated structure and abrasion resistant steel. The crenellated structure has a solid region, more than one raised region, and more than one trough region.

The invention herein will be better understood by reference to the figures wherein like reference numbers refer to like components.

FIG. 1 illustrates a standard snow-plow mold board (101) indicating how an embodiment of the current invention is to be positioned and affixed to the mold board (101). Bolts (not shown) are used to affix each blade (103) to the mold board through blade defined holes (102) to mold board defined holes (150). Bolts are the most common method for affixing blades (103), however blades (103) can be machined to accommodate other fasteners and methods of fastening. The cover-plate (104) is shown covering the lower portion of the blade (103). The crenelated design structure of the cover-plate (104) is also shown, with the cover-plate (104) spanning the width of the blade (103). Also illustrated are multiple blades (103) being affixed to the mold board (101).

Figure 2:
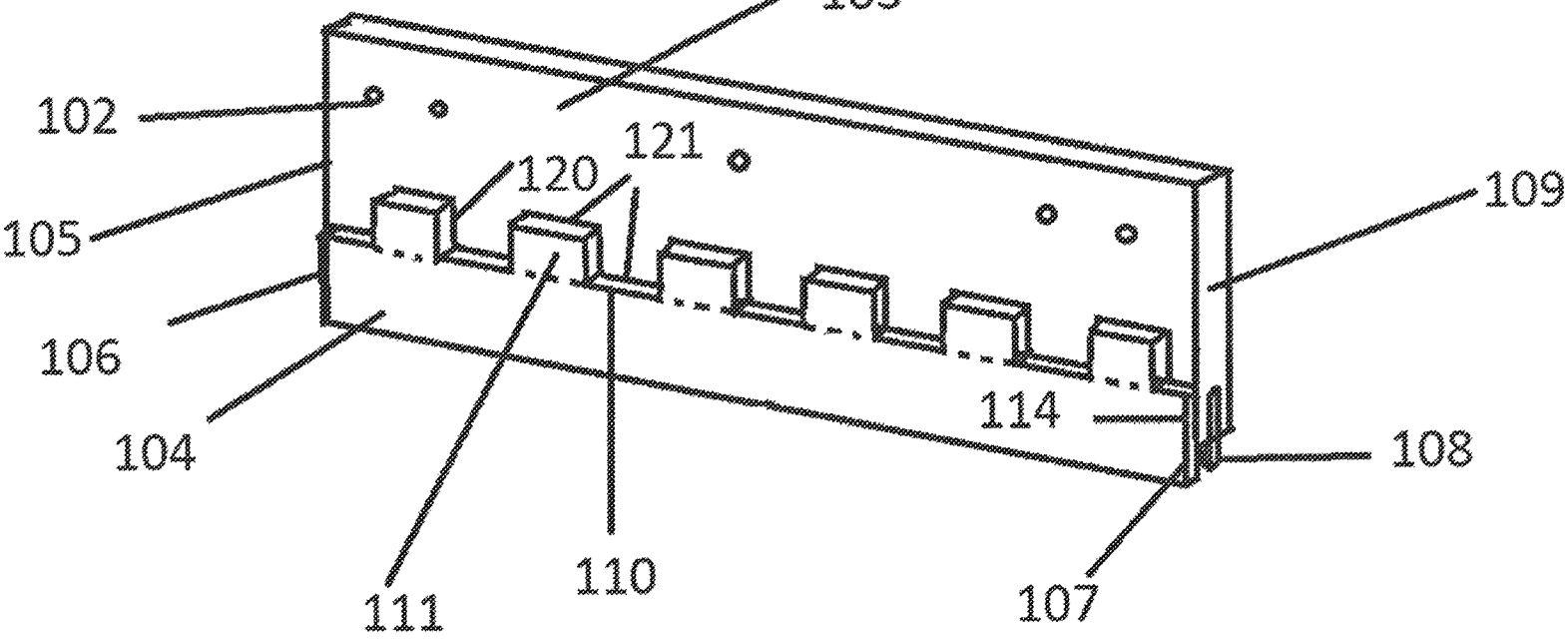
FIG. 2 depicts a perspective view of snow-plow blade, cover-plate, and crenellated structure of the current invention.

FIG. 2 illustrates a perspective view of the current invention, depicting a snow-plow blade as an integrated structure, with a blade (103), a cover-plate (104), and an insert (108). Further indicated are the blade left side edge (105) and the blade right side edge (109). The cover-plate (104) is show affixed to the blade (103), illustrating cover-plate overhang (107). The cover-plate left side edge (106) and the cover-plate right side edge (114) are shown substantially extending from the blade left side edge (105) to the blade right side edge (109). The insert (108) is shown in and extending below the blade (103). More than one raised region (111) and more than one trough region (110) are also shown, atop a solid region (not labeled). The trough region (110) is also used as a wear indication line for blade replacement. Vertical welds (120) and horizontal welds (121) are also indicated.

Figure 3:
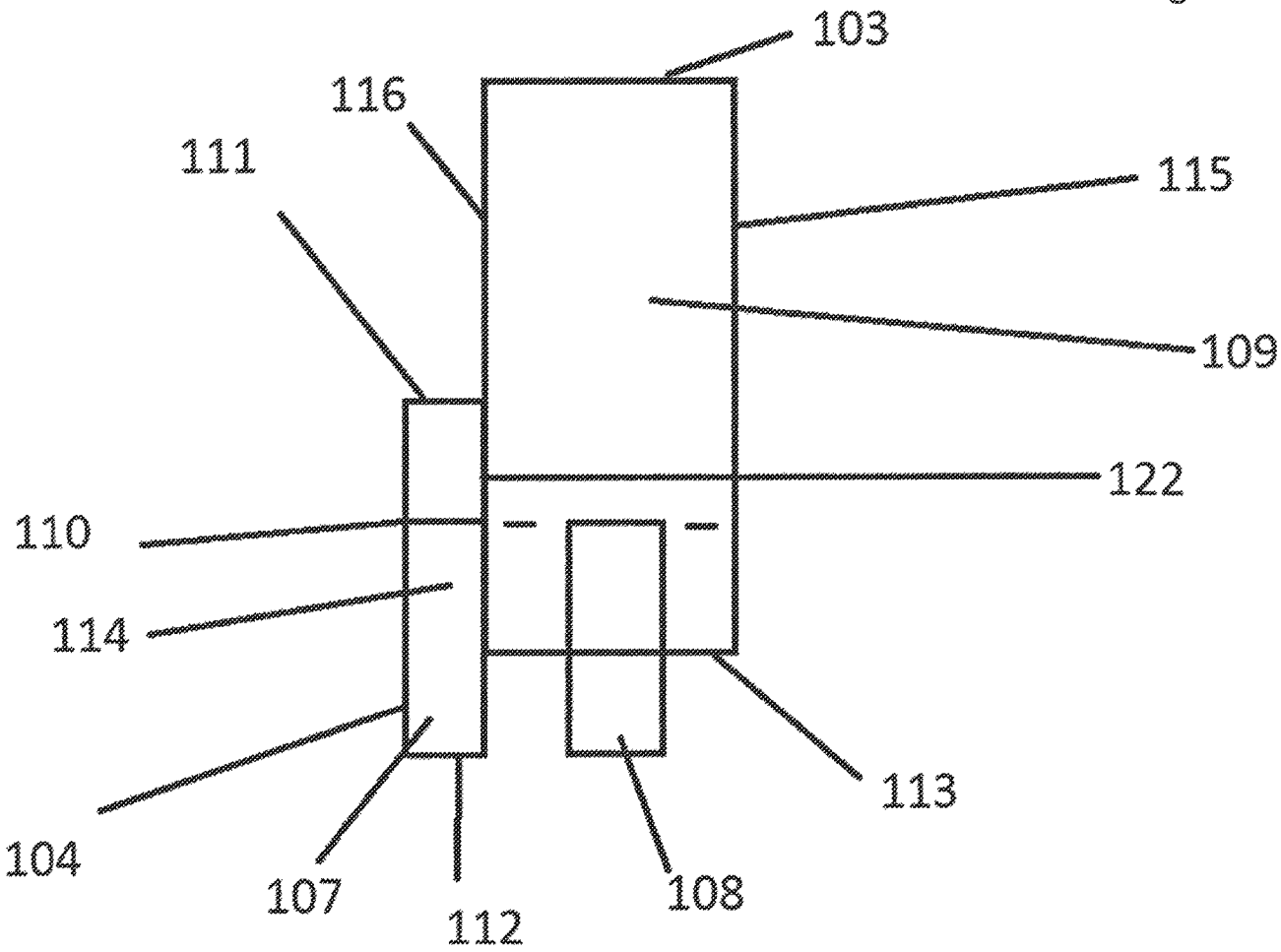
FIG. 3 depicts a side view of a snow-plow blade of the current invention, with insert and cover-plate.

FIG. 3 illustrates a side view of an embodiment of the current invention. The blade (103) includes the blade right side edge (109), the blade back face (115), the blade front face (116), and the blade bottom edge (113). The insert (108) can be seen between the blade front face (116) and the blade back face (115). Affixed to the blade (103) is the cover-plate (104) including the right side edge (114), the overhang (107), the cover-plate bottom edge (112), the raised region (111), and the trough region (110) where the trough region is also a wear indicator. The cover-plate back face (122) is also indicated.

Figure 4:
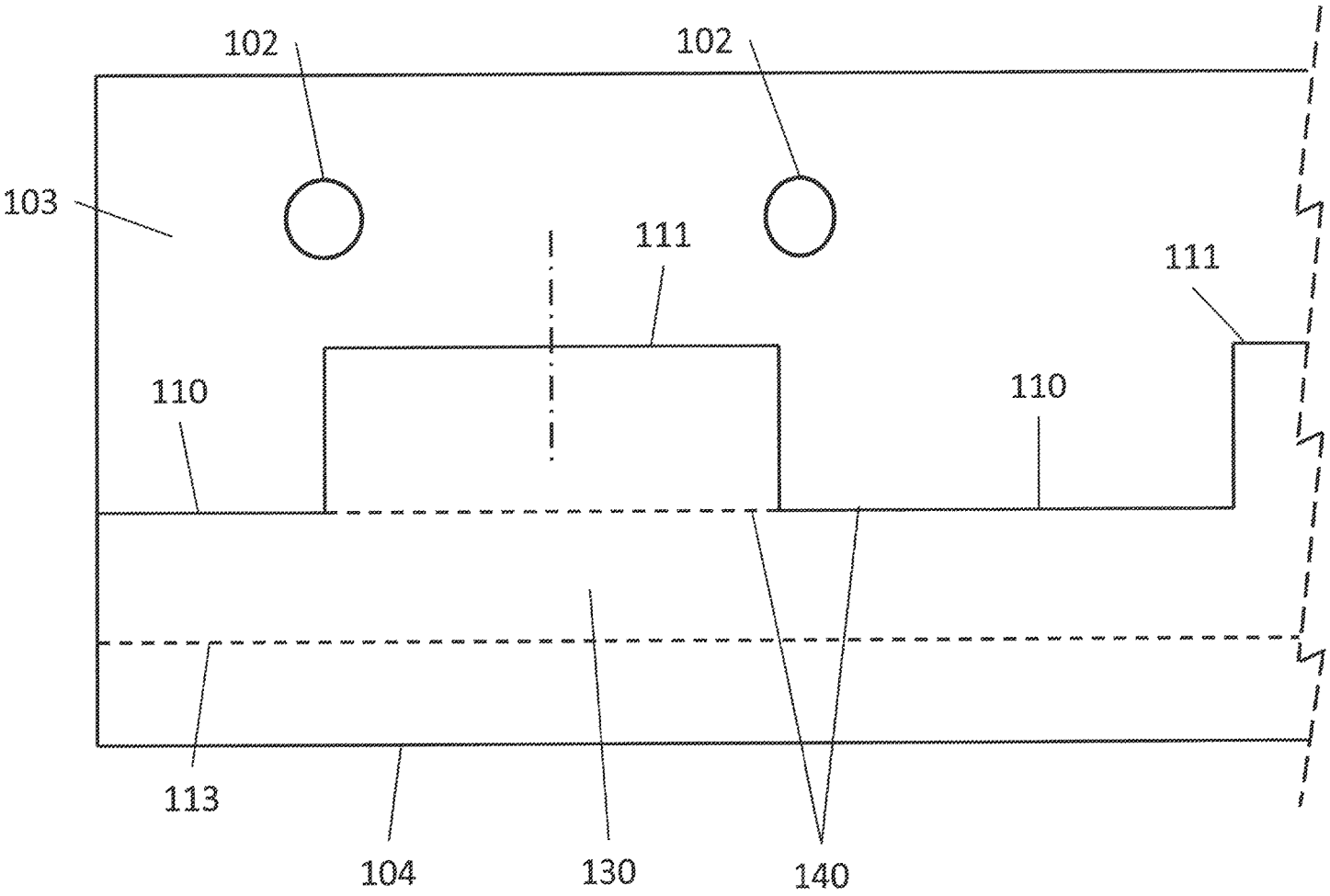
FIG. 4 depicts a front view of the crenellated structure of a cover-plate of the current invention.

FIG. 4 depicts a front view of a section of a snow-plow blade. In this embodiment a blade (103) with a cover-plate (104) is shown. Blade defined holes (102) in the blade for connection to a mold board are shown. On the cover-plate (104) raised regions (111), trough regions (110), and a solid region (130) are depicted. Also shown, is a wear indicator line (140), and the position of the blade bottom edge (113) behind the cover-plate (104). The wear indicator line (140) is the bottom of the trough region meeting the top of the solid region (130).

The blade (103) is generally a carbon steel alloy, which may include additives such as boron, tungsten, carbide, or other materials to provide the required balance between hardness and flex. Blades may also be made from a rubber and rubber composites. The composition of the blade (103) will depend on the plowing application. The blade (103) thickness is generally ¾ inches (19 mm) thick, but may vary. The blade (103) height is generally from 5 inches to 8 inches (127 mm to 203 mm) high.

The insert (108) is generally made from a carbide based material and may include but is not limited to additives such as tungsten or cobalt. Insert configuration will vary with common designs including but not limited to a trapezoid, a tall trapezoid, a bullnose, and a tall bullnose. The carbide insert (108) may be of any configuration but the preferred embodiment is a bullnose round head tungsten carbide insert.

The cover-plate (104) is made from an abrasion resistant steel or abrasion resistant steel plate. The preferred hardness for steel used in the cover-plate (104) is 425-HBW or 450 HBW+/−25. The preferred yield tensile strength for the steel is 1100-MPa. The preferred ultimate tensile strength is 1250-1450 MPa. Furthermore, steel used for the cover-plate (104) should have substantial impact resistance. The preferred impact resistance properties for cover-plate steel are at least 27J/−20° C. for a transverse test and 50J/−40° C. longitudinal test, where the impact testing is performed in accordance with ISO EN 148 per heat and thickness group for an average of 3 tests. Any steel that is substantially near to or within the mechanical material property ranges of abrasion resistant steel may be suitable. Steel that is substantially near to or within these mechanical property ranges suitably balances hardness and impact resistance properties.

Cover-plate (104) sizes vary greatly as do structure design configurations. It is common that blade and cover-plates will be 1⅜ inches (34.9 mm) thick by 6 inches (152 mm) high by 132 inches (3.35 m) wide. Blades are usually ¾ inches (19 mm) thick, with cover plates usually being ⅝ inches (15.9 mm) thick. There are designs that have the cover-plate affixed to the blade, however they have plates that are ⅝ inches (15.9 mm) thick by at least 3 inches (76.2 mm) high above the bottom blade edge.

The cover-plate (104) of a preferred embodiment of the invention is a crenellated structure, such that the cover-plate is a HARDOX® 450 abrasion resistant steel that is ⅜ inches (9.5 mm) thick by 2 inches (50.8 mm) tall, where height is measured from the cover-plate bottom edge (112) to the top of the raised region (111). The height is 1 inch (25.4 mm) from the cover-plate bottom edge (112) to the trough region, and the cover-plate is affixed so that the cover-plate bottom edge (112) has an overhang of ⅜ inches (9.5 mm) below the blade bottom edge (113). The overhang may vary with the type of insert (108) used, with the overhang being of such length so as to protect the insert (108). When the cover-plate (104) is affixed to the blade (103), the thickness is approximately 1⅛ inches (28.6 mm) thick. Such a configuration may provide for attack angles from 55 to 90 degrees while the insert (108) and/or the cover-plate (104) are still in functional contact with the plowing surface. In some embodiments, the cover-plate (104) may act as a second blade as well a guard for the blade (103) and carbide insert (108). The trough region (111) also acts as a wear indicator (140) to visually show the insert wear life. Blade (103) and insert (108) wear may easily be seen from a distance and not require special tools, or measuring devices, or component removal.

The snow-plow blade of the current invention has the cover-plate (104) affixed to the blade (103) having an insert (108). The embodiment of the snow-plow blade of the current invention comes in standard widths of 36 inches (0.91 m), 40 inches (1.02 m), 40⅞ inches (1.04 m), 44 inches (1.12 m), 46⅞ inches (1.19 m), and 48 inches (1.22 m). Approximate standard weights for commercially available blades with carbide inserts are approximately 48 lbs. (21.8 kg) for a 36 inch (0.91 m) blade, and 64 lbs. (29.1 kg) for a inch (1.22 m) blade. A standard 132 inch (3.35 m) steel cover weighs approximately lbs (75 kg). For a 132 inch (3.35 m) mold board (101) width, a standard blade (1×inch+2×48 inch) (1×0.91 m+2×1.22 m) and cover configuration would weigh approximately 341 lbs (155 kg). Using the current invention, the same blade (103) configuration (1×36 inch+2×48 inch) (1×0.91 m+2×1.22 m) with cover-plates (104), with each segment being an integrated structure, would weigh approximately 187 lbs (85 kg). The current invention has the further benefit of being attachable to the mold board in segments.

Current municipal plows may allow for multiple snow-plow blades to be affixed to a mold board but the cover-plate is usually not integrated with the snow-plow blades. The cover-plate is commonly a single large plate attached to the snow-plow blades. The current invention has an integrated structure for the snow-plow blade where the cover-plate (104) is affixed to the blade (103) and insert (108). The crenellated structure provides blade (103) protection while using less material. The current invention is also lighter than other snow-plow blade configurations, making blade replacement easier and safer. The lighter weight of the current invention makes it possible for a single person to install the snow-plow blades instead of requiring a group of people, particularly because each snow-plow blade is an integrated structure that may be installed in segments.

For a snow-plow, the cover-plate (104) is used to protect the blade (104) and insert (108) because the insert (108) is generally a very hard yet brittle material. The invention enables a range of blade configurations, without having to replace blades, because of the combination of insert (108), cover-plate material hardness, and cover-plate overhang (107). The cover-plate (104) may further act as a second blade.

The cover-plate (104) may be affixed to the blade (103) using a variety of fasteners and fastening methods, including but not limited to bolts and welding. The preferred embodiment of the current invention includes both vertical welds (120) and horizontal welds (121) along the top and sides of the raised region (111) and along the trough regions (110). Furthermore, the cover-plate back face (122) is fully welded to the blade front face (116). The high weld surface and the use of abrasion resistant steel for the cover-plate (104) material creates blade (103) and insert (108) protection that improves snow-plow blade service life.

The crenellated structure of the cover-plate (104) provides material savings. The shape of the raised regions (111) may be any shape, so long as the adjacent trough region (110) shape is a cutout of substantially the same shape when rotated 180 degrees. Substantially rectangular, triangular, or trapezoidal shapes may be better suited but any shape may be used in the crenellated structure. Heights, widths, and thicknesses of the raised regions (111) and the trough regions (110) may vary to accommodate the blade (103) sizing requirements. In a preferred embodiment, each trough region (110) is substantially 2 inches (50.8 mm) wide, except the trough region (110) at the cover-plate left edge (106) and the trough region at the cover-plate right edge (114), which are each substantially 1 inch (25.4 mm) wide. The raised region (111) is substantially two inches (50.8 mm) wide and substantially one inch (25.4 mm) above the trough region (110) making the raised region (111) substantially rectangular in shape. The solid region (130) dimensions may vary with the blade and insert dimensions and configurations. The solid region (130) is that region of the cover-plate (104) below the crenellated structure.

NON-LIMITING EMBODIMENTS

Embodiment 1 is a snow-plow blade comprising a blade, an insert, and a cover-plate. The blade comprises a blade front face and a blade bottom edge and the insert is affixed to the blade such that a portion of the insert extends below the blade bottom edge. The cover-plate comprises abrasion resistant steel and a crenellated structure. The crenelated structure comprises a solid region, more than one raised region, and more than one trough region. The cover-plate is affixed to the blade front face, said cover-plate substantially spanning the width of the blade, and with a portion of the cover-plate solid region extending below the bottom edge of the blade.

Embodiment 2 is the snow-plow of embodiment 1 wherein the cover-plate is further affixed to the blade front face such at least one trough region is a wear indicator.

Embodiment 3 is the snow-plow blade of embodiment 1 wherein the cover-plate is adapted for weld attachment to the blade front face, and is affixed to the blade front face with at least one weld substantially along the crenellated structure in contact with said blade front face.

Embodiment 4 is the snow-plow blade of embodiment 3 wherein the cover-plate, blade, and insert, are an integrated structure, and said integrated structure is attachable to a snow-plow mold board, wherein the snow-plow mold board comprises at least two integrated structures.

Embodiment 5 is the snow-plow blade of embodiment 4 wherein the blade is attachable to a snow-plow mold board in configurations comprising a snow-plow blade having attack angles of 55 to 90 degrees.

Embodiment 6 is the snow-plow blade of embodiment 1 wherein the trough regions of the crenellated structure are substantially cutouts in the shape of the raised region.

Embodiment 7 is the snow-plow blade of embodiment 4 wherein the raised regions of the crenellated structure are substantially rectangular.

Embodiment 8 is a cover-plate for a snow-plow blade having a crenellated structure and abrasion resistant steel. The crenelated structure comprises a solid region, more than one raised region, and more than one trough region. The cover-plate is affixed to the blade front face, said cover-plate substantially spanning the width of the blade, and with a portion of the cover-plate solid region extending below the blade bottom edge.

Embodiment 9 is the cover-plate for a snow-plow of embodiment 8 wherein the cover-plate is further affixed to the blade front face such that at least one trough region is a wear indicator.

Embodiment 10 is the cover-plate for a snow-plow of embodiment 8 wherein the cover-plate is adapted for weld attachment to the blade front face; and is affixed to the blade front face with at least one weld substantially along the crenellated structure in contact with the blade.

Embodiment 11 is the cover-plate for a snow-plow of embodiment 10 wherein the cover-plate, blade, and an insert, are an integrated structure, and said integrated structure is attachable to a snow-plow mold board, wherein the snow-plow mold board comprises at least two integrated structures.

Embodiment 12 is the cover-plate for a snow-plow of embodiment 8 wherein the cover-plate is attached to the blade, and the blade is attachable to a mold board in configurations comprising attack angles of substantially 55 to 90 degrees.

Embodiment 13 is the cover-plate for a snow-plow of embodiment 8 wherein the trough regions of the crenellated structure are substantially cutouts in the shape of the raised region.

Embodiment 14 is the cover-plate for a snow-plow of embodiment 11 wherein the raised regions of the crenellated structure are substantially rectangular.

Embodiment 15 is an improvement for extending the service life of the blade and improving blade maintenance servicing in a snow-plow which comprises a cover-plate affixed to the front of a blade, the cover-plate extending below the blade bottom edge, and said cover-plate spanning the width of the blade. Each cover-plate has a crenellated structure and abrasion resistant steel. The crenellated structure has a solid region, more than one raised region, and more than one trough region.

Embodiment 16 is the improvement of embodiment 15 wherein the trough region further is a wear indicator Embodiment 17 is the improvement of embodiment 15 wherein the cover-plate, blade, and insert, are an integrated structure, and said integrated structure is attachable to a snow-plow mold board, wherein the snow-plow mold board comprises at least two integrated structures.

Embodiment 18 is the improvement of embodiment 17 wherein the blade is attachable to a mold board in configurations comprising attack angles of substantially 55 to 90 degrees.

Embodiment 19 is any one of embodiments 1-18 combined with any one or more embodiments 2-18.

What is claimed is:

1. A snow-plow blade comprising:

a blade, an insert, and a cover-plate; wherein the blade comprises a blade front face, a blade back face, and a blade bottom edge; wherein the insert is affixed to the blade such that a portion of the insert extends below the blade bottom edge; wherein the cover-plate comprises abrasion resistant steel and a crenellated structure; wherein the crenelated structure comprises a solid region, more than one raised region, and more than one trough region; wherein the cover-plate is affixed to the blade front face, said cover-plate substantially spanning the width of the blade, and with a portion of the cover-plat e solid region extending below the blade bottom edge; wherein the cover-plate is attached to the blade front face with at least one weld substantially along the crenellated structure in contact with the blade front face; wherein the snow-plow blade is attachable to a snow-plow mold board; wherein the snow-plow blade is without devices, attachments, or support structures affixed to the blade back face except for attachment to the snow-plow mold board; and wherein being without devices, attachments, or support structures affixed to the blade back face provides for the mold board attached snow-plow blade having attack angles of 55 to 90 degrees.

2. The snow-plow blade of claim 1 wherein the cover-plate is further affixed to the blade front face such that at least one trough region is a wear indicator.

3. The snow-plow blade of claim 1 is attachable to the snow-plow mold board, wherein the snow-plow mold board comprises at least two snow-plow blades.

4. The snow-plow blade of claim 1 wherein the trough regions of the crenellated structure are substantially cutouts in the shape of the raised regions and wherein each raised region has the same width as each adjacent trough region.

5. The snow-plow blade of claim 4 wherein the raised regions of the crenellated structure are substantially rectangular.

6. The snow-plow blade of claim 1 wherein the insert and the cover-plate are in functional contact with a plowing surface.

7. The snow-plow blade of claim 6 wherein the snow-plow blade is in functional contact with the plowing surface.

8. A cover-plate for a snow-plow blade comprising:

a crenellated structure and abrasion resistant steel; wherein the crenelated structure comprises a solid region, more than one raised region, and more than one trough region; wherein the cover-plate is affixed to a blade front face, said cover-plate substantially spanning the width of the blade, and with a portion of the cover-plate solid region extending below the blade bottom edge; wherein the cover-plate is for attachment to the blade front face and the cover-plate is affixed to the blade front face with at least one weld substantially along the crenellated structure in contact with the blade front face; wherein the snow-plow blade is attachable to a snow-plow mold board; wherein the snow-plow blade has a back face, with the back face being without devices, attachments, or support structures affixed to the blade back face except for attachment to the snow-plow mold board; and wherein being without devices, attachments, or support structures affixed to the blade back face provides for the mold board attached snow-plow blade having attack angles of 55 to 90 degrees.

9. The cover-plate of claim 8 wherein the cover-plate is further affixed to the blade front face such that at least one trough region is a wear indicator.

10. The cover-plate of claim 8 wherein the cover-plate, blade, and an insert, are the snow-plow blade, wherein the snow-plow mold board comprises at least two snow-plow blades.

11. The cover-plate of claim 8 wherein the trough regions of the crenellated structure are substantially cutouts in the shape of the raised region and wherein each raised region has the same width as the adjacent trough region.

12. The cover-plate of claim 11 wherein the raised regions of the crenellated structure are substantially rectangular.

13. The snow-plow blade of claim 8 wherein the insert and the cover-plate are in functional contact with a plowing surface.

14. The snow-plow blade of claim 13 wherein the snow-plow blade is in functional contact with the plowing surface.

15. In a snow-plow blade the improvement for extending the service life of the snow-plow blade and improving snow-plow blade maintenance servicing which comprises:

a cover-plate affixed to a blade front face, the cover-plate extending below the blade bottom edge, and said cover-plate spanning the width of the blade, with each cover-plate comprising:

a crenellated structure and abrasion resistant steel; the crenellated structure having a solid region, more than one raised region, and more than one trough region; wherein the snow-plow blade has a back face, the back face being without devices, attachments, or support structures affixed to the blade back face except for attachment to a snow-plow mold board; and wherein being without devices, attachments, or support structures to the blade back face provides for the mold board attached snow-plow blade having attack angles of 55 to 90 degrees.

16. The snow-plow blade of claim 15 wherein the trough region further is a wear indicator.

17. The snow-plow blade of claim 15 wherein the cover-plate, blade, and insert, are an integrated structure, and said integrated structure is attachable to a snow-plow mold board, wherein the snow-plow mold board comprises at least two integrated structures.

18. The snow-plow blade of claim 15 wherein the insert and the cover-plate are in functional contact with a plowing surface.

19. The snow-plow blade of claim 18 wherein the snow-plow blade is in functional contact with the plowing surface.

* * * * *